United States Patent [19]

Fernstrom et al.

[11] 4,301,102

[45] Nov. 17, 1981

[54] SELF-CRIMPING POLYAMIDE FIBERS

[75] Inventors: George A. Fernstrom; Harold H. Hebeler; Perry H. Lin; Robert R. Moneymaker, all of Seaford, Del.

[73] Assignee: E. I. Du Pont de Nemours and Company, Wilmington, Del.

[21] Appl. No.: 57,973

[22] Filed: Jul. 16, 1979

[51] Int. Cl.[3] ..... B29C 17/00; D01D 5/22; D02G 3/00

[52] U.S. Cl. ..... 264/151; 264/168; 264/210.5; 264/210.8; 428/364; 428/369; 428/371

[58] Field of Search ..... 264/148, 151, 168, 176 F, 264/210.3, 210.8, 210.5; 428/369, 371, 364

[56] References Cited

U.S. PATENT DOCUMENTS

| | | | |
|---|---|---|---|
| 2,875,019 | 2/1959 | Spohn et al. | 264/168 |
| 2,957,747 | 10/1960 | Bowling | 264/168 |
| 3,118,012 | 1/1964 | Kilian | 264/168 |
| 3,135,646 | 6/1964 | Hayden | 264/168 X |
| 3,213,171 | 10/1965 | Kilian | 264/168 |
| 3,271,943 | 9/1966 | Williams, Jr. | 264/168 X |
| 3,600,271 | 8/1971 | Ono et al. | 264/168 X |
| 3,623,939 | 11/1971 | Ono et al. | 264/168 X |
| 3,854,177 | 12/1974 | Breen et al. | 28/1.4 |
| 3,920,784 | 11/1975 | Nakagawa et al. | 264/168 |
| 3,953,962 | 5/1976 | Breen et al. | 28/72.12 X |
| 4,038,357 | 7/1977 | Boyes et al. | 264/168 |

FOREIGN PATENT DOCUMENTS 2010738 7/1979 United Kingdom .

*Primary Examiner*—Lorraine T. Kendell

[57] ABSTRACT

A process is provided for preparing self-crimpable monocomponent fibers by the sequential steps of melt-spinning a polymer of polyhexamethylene adipamide or polycaproamide into filaments, quenching the filaments by a cross-flow of air to an average surface temperature of about 40° to 130° C., applying an effective amount of water to the filaments while they are in said temperature range, and then drawing the filaments at a draw ratio of at least 1.3:1 to obtain a tenacity of at least 1.3 gpd, a break elongation of less than 120% and a latent, substantially helical, frequently reversing crimp of at least 6 filament crimp index. The novel products of the invention, which include fibers and yarns, in self-crimpable or crimped condition, are particularly suited for use in carpets.

7 Claims, 6 Drawing Figures

SELF-CRIMPING POLYAMIDE FIBERS

TECHNICAL FIELD OF THE INVENTION

This invention relates to self-crimping polyamide fibers. More particularly, the invention concerns a spinning, quenching and drawing process for preparing such fibers and the novel fibers and yarns made thereby.

BACKGROUND

Polyamide carpet yarns usually are manufactured from continuous filaments or staple fibers that are already crimped of that have the ability to self-crimp upon being subjected to a heat treatment in a relaxed condition. The most commonly used polyamides for this purpose are polyhexamethylene adipamide (i.e., nylon 66) and polycaproamide (i.e., nylon 6). As a result of the crimp, the carpet yarns are bulky and provide carpets with the desired covering power, resilience and softness.

Numerous processes are known in the art wherein a melt-spun, quenched and drawn polyamide fiber is subjected subsequently to a special mechanical operation to produce a bulky yarn. The book by B. Piller, "Bulked Yarns", The Textile Trade Press, Manchester, England (1973) provides an excellent review of many of these known mechanical operations, including twist-texturing, stuffer-box crimping, knit de-knit texturing, gear-wheel crimping, pin texturing and edge crimping. Although each of these methods provides useful crimp to the fibers, each requires additional equipment, capital and energy beyond that required for the usual melt-spinning, quenching and drawing steps of synthetic fiber production. Furthermore, many of these mechanical operations often damage or weaken the fibers.

Piller also discloses the production of non-stretch bulked yarns by air-texturing methods. In these methods, a yarn is treated with a jet of compressed air which separates the individual filaments of the yarn and forms them into a looped structure. While being entangled into loops the yarn becomes shorter and bulkier.

A particularly useful technique for commercially preparing carpet yarns is jet-screen bulking of the type disclosed by Breen et al., U.S. Pat. No. 3,854,177. This technique provides a random, three-dimensional, non-helical curvilinear crimp to the fibers by passing a continuous filament yarn through a hot-fluid jet and onto a foraminous surface.

Processes have also been suggested for preparing crimped polyamide fibers which do not require special additional mechanical treatments subsequent to the fiber production steps. These processes involve specific melt-spinning or quenching techniques and provide the fibers with the ability to self-crimp when subjected to a heat-treatment in a relaxed condition. Included among these techniques are high speed spinning, jet quenching, special asymmetric liquid cooling, spinning of bicomponent fibers and spinning of fibers of asymmetric cross-section.

Bowling, U.S. Pat. No. 2,957,747, discloses a high speed spinning technique for providing spontaneously crimpable polyamide fibers which on relaxed heat treatment form small, irregular undulations. Bowling discloses melt-spinning, cross-flow quenching and attenuating velocities (without any mechanical drawing) of 3,000 to 6,000 yards per minute. However, Bowling notes that polyhexamethylene adipamide yarns made in this manner must be relaxed within a few minutes after attenuation (i.e., before significant tension is applied to the filaments) if the yarn thereafter is to be spontaneously crimpable.

Kilian, U.S. Pat. No. 3,118,012 suggests that a high velocity air jet directed against melt-spun polyamide filaments close to the face of the spinneret can provide filaments which are spontaneously crimpable. However, such high air velocities can cause problems with threadline control and denier uniformity.

A special liquid-cooling method for producing crimped fibers is suggested by Boyes et al., U.S. Pat. No. 4,038,357. In the suggested method, hot melt-spun filaments are initially partially cooled evenly by a radial outflow of air, starting at the spinneret and extending for 3 to 10 inches below the spinneret, and then further cooled by contact with a liquid film, which is thinner than the filaments, in such a manner that one side only of each filament contacts the liquid film.

Helical self-crimp also can be imparted to a polyamide fiber by melt spinning the fiber as a composite of two distinct compositions differing in shrinkage characteristics. Such fiers, which are known as bicomponent or conjugate fibers, require more complicated spinning equipment (i.e., extruders, piping and spinnerets) and are more costly and less efficient to produce than ordinary monocomponent fibers.

Several references have disclosed that self-crimping could be provided by melt-spinning and cross-flow cooling of fibers which have cross-sections of special geometry. For example, Hayden, U.S. Pat. No. 3,135,646, suggests that "bulbous or keyhole" cross-sections result in helically crimped fibers. Other types of cross-sections, in which the mass of the fiber is distributed eccentrically around the longitudinal axis of the fiber, have been disclosed by Nakagawa et al., U.S. Pat. No. 3,920,784 and Ono et al., U.S. Pat. No. 3,623,939. Ono et al. also suggest that special cross-sections which provide the fibers with an eccentric shrinkage property with respect to the centroid of the cross-section can be melt-spun at take-up speeds of at least 3000 meters per minute and can produce fine curl-like crimps in the fiber.

Although some of the above-described prior-art techniques can produce helically crimped filaments, applicants have found that such yarns can suffer from "follow-the-leader" crimp, which are bulky per se, but when used in carpets, do not provide the carpet with adequate bulk.

To avoid such problems associated with the prior-art techniques, applicants have invented an efficient, surprisingly simple and energy-conserving sequence of steps that produces a range of novel helically crimped polyamide fibers which generally are suited for use in bulked fiber applications, such as upholstery, and which are suited particularly for use in carpet yarns.

SUMMARY OF THE INVENTION

The present invention provides an improved process for preparing self-crimpable monocomponent fibers. The process is of the type that includes the sequential steps of melt spinning a polymer of polyhexamethylene adipamide or of polycaproamide into filaments, quenching the filaments with a flow of air, contacting the filaments with water and then mechanically drawing the filaments. The inventive improvement in this sequence of steps comprises: (a) quenching the filaments by a cross-flow of air to an average surface temperature in the range of about 40° to 130° C.; (b) while the filaments are at said surface temperature, applying an effective amount of an aqueous liquid to the surface of the filaments; and (c) mechanically drawing the filaments at a draw ratio of at least 1.3:1 to provide the filaments with a tenacity of at least 1.3 grams per denier, a break elongation of no greater than 120% and an ability, when subjected to a heat relaxation treatment, to develop a substantially helical, frequently reversing crimp of at least 6 filament crimp index. In a preferred embodiment, continuous filaments of the process are treated subsequently in a hot-fluid jet.

The present invention also provides novel self-crimpable fibers and yarns as well as fibers and yarns in which the helical self-crimp has been developed. In particular, a self-crimpable fiber of the present invention is a monocomponent, nonbulbous, drawn fiber of polyhexamethylene adipamide or of polycaproamide. The drawn self-crimpable fiber, whether in continuous filament or staple fiber form, has a crystal perfection index of no greater than 70, a tenacity of at least 1.3 grams per denier and a break elongation of no greater than 120% and develops, when subjected to a heat treatment in a relaxed condition, a substantially helical, frequently reversing crimp with a filament crimp index of at least 6. Yarns containing these fibers usually develop a bundle crimp elongation of at least 20% when subjected to the heat treatment in a relaxed condition. An unusual feature of preferred self-crimpable fibers and yarns of the invention is that they increase their tenacity when subjected to the crimp-developing heat treatment.

The helically self-crimped fiber of the invention is a drawn, nonbulbous, monocomponent fiber of polyhexamethylene adipamide or of polycaproamide and has a tenacity of at least 1.3 grams per denier, a break elongation of no greater than 120%, an average crimp frequency of at least 1.2 crimps per centimeter of extended fiber, an average frequency of crimp reversal of at least 0.6 per centimeter of extended fiber and a filament crimp index of at least 6.

DETAILED DESCRIPTION OF THE INVENTION

Figure 1:
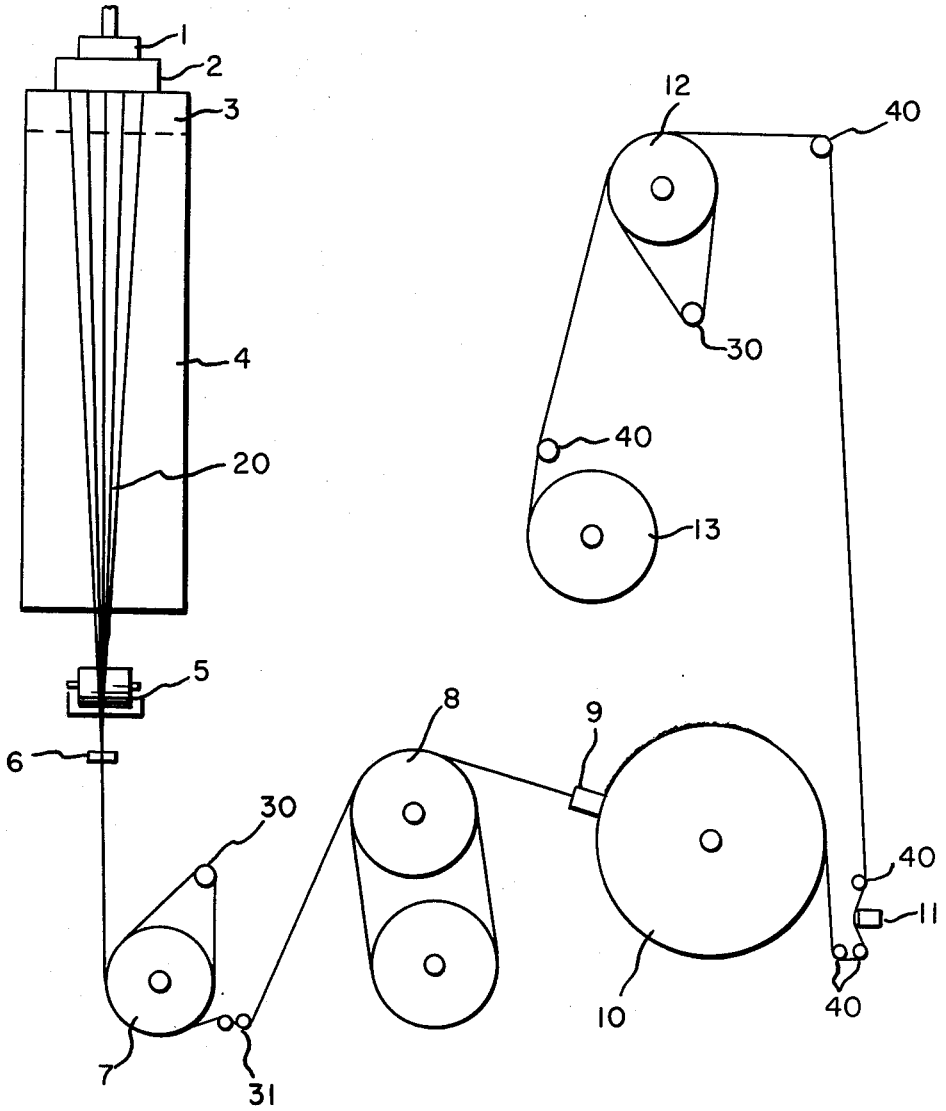
FIG. 1, which is described in detail in Example 1, is a schematic diagram of a continuous process for making self-crimpable, continuous filament yarns in accordance with the present invention.

As used in this description, the term "fibers" includes both continuous filaments and staple fibers, except where obviously limited to staple fibers. The term "nonbulbous" excludes the "bulbous or keyhole" cross-sections defined by Hayden, U.S. Pat. No. 3,135,646.

The present process of spinning, quenching, applying aqueous liquid and drawing provides latent crimp or "self-crimpability" to the resultant fibers. The cross-sections of the fibers are substantially free of the types of distortions imparted to crimped fibers by mechanical deformation techniques, such as edge crimping, false-twist texturing, stuffer-box crimping, etc. The present process provides self-crimpability without having to prepare fibers of bulbous cross-sections or of other cross-sections of special geometry in which the mass is eccentrically distributed about the fiber axis. Also, the present process requires neither high-speed spinning (i.e., greater than 3000 yards per minute) nor highly asymmetric liquid cooling (e.g., as described in Boyes et al. U.S. Pat. No. 4,038,357). The self-crimpability is believed to be imparted in the present process by asymmetric quenching effects which are preserved or even enhanced by the particular aqueous-liquid application and drawing steps, which are described in detail below.

The self-crimpability or latent crimp imparted to the fibrs by the process of the present invention becomes fully developed when the fibers are subjected to a heat treatment in a relaxed condition. One such convenient heat treatment, which is used as a standard treatment herein, involves heating the fibers in a relaxed condition for at least 3 minutes in boiling water at about 100° C. After the relaxed heat treatment, the fibers exhibit a substantially helical, frequently reversing crimp of at least 6 filament crimp index. Other methods of relaxed heat treatment can be used to develop the crimp. It should be noted that some of the crimp can become developed without any heat treatment, but for full development of the crimp a relaxed heat treatment usually is required.

The self-crimpable fibers and yarns of the present invention are prepared from polymers of polyhexamethylene adipamide (i.e., nylon 66) or of polycaproamide (i.e., nylon 6). Polymers of polyhexamethylene adipamide are preferred. It is especially preferred that fibers or yarns produced from the nylon 66 have a relative viscosity of at least 50. The fibers of the invention are monocomponent fibers; that is, the fibers are made of a single, fiber-forming polymeric composition and are not bicomponent or conjugate fibers. The nylon 66 or nylon 6 polymer may contain as much as 10% of comonomers and/or other conventional additives, such as antioxidants, light stabilizers, delustering agents, etc.

The conditions for melt-extruding the polymer for the fibers of the present invention are known in the art. Extrusion rates in the range of about 1 to 7 grams per minute per spinneret orifice usually are satisfactory. Within this range, the higher rates usually provide higher crimpability. However, for reasons of process control and fiber uniformity, extrusion rates in the range of 2 to 5 g/min/orifice are preferred. The final fibers, which are produced by the process and are suitable for use in carpet yarns, have a denier that is usually between 5 and 40 denier per filament and preferably between 5 and 25. Below 5 denier per filament, the crimpability imparted to the fibers by the process of the invention is greatly diminished. The total denier of carpet yarns produced from fibers of the invention can be as low as 500, but usually is between 1000 and 5000. The orifices are designed to provide the desired fiber cross-section. As noted above, the fiber cross-section is not bulbous. Also there is no need for the mass to be eccentrically distributed about the fiber axis. Rather, the spinneret and fiber-forming conditions are preferably designed to provide a "balanced" cross-section, such as a circular cross-section or a balanced multilobal (e.g., trilobal) cross-section. The shape factor of the cross-sections of the fibers of the present invention is usually in the range of 1 to 2.5. Trilobal fibers having shape factors at the higher end of the shape factor range generally possess greater self-crimpability than fibers of the invention of circular cross-section (i.e., those having a shape factor of 1.0).

After melt extrusion, the filaments are quenched by a cross-flow of air. Because the cross-flowing air impinges upon one side of the filament before flowing around the filament surface to the opposite side, it is believed that the filaments are cooled somewhat asymmetrically and that the cross-flow thereby introduces latent crimpability in the filaments. Generally, average air velocities of less than 3 meters per second are satisfactory. Although somewhat higher velocities can be employed to enhance the crimpability provided by the present process, average velocities in the range of 0.1 to 1.5 meters per second are preferred. These gentle velocities of the present process are in sharp contrast to past suggestions for imparting helical crimp by impinging high velocity air jets against the melt-spun filaments immmediately as they emerge from the spinnerets. The gentle velocities avoid the threadline disruptions and filament nonuniformities often associated with the high velocity jet-quenching technique. When producing trilobal fibers according to the present process, it is preferred to direct the cross flow toward the tip of one of the lobes of the fiber cross-section, rather than toward the area between lobes, in order to enhance the latent crimp.

Cross-flow air-quenching zones useful for this invention extend for a distance of at least about 70 centimeters from just downstream of the spinneret orifices to just upstream of the aqueous-liquid applicator. Zones of about 1.5 meter long have been found very useful. However, zones of more than about 3 meters long are generally not as useful. Longer zones with their longer exposure of the moving threadline to the quench air before the aqueous liquid is applied can cause loss of latent crimpability. This loss is believed to be due to relieving of asymmetries initially imparted to the filaments by the cross-flowing air.

The quenching provided by the gentle cross-flow of air cools the filaments to an average surface temperature which is in the range of about 40° to 130° C., at which point aqueous liquid is applied to the filaments. As shown in Example 4, as this surface temperature decreases to below about 40° C., the crimpability of the filaments decreases to values which are inadequate, especially for use in carpet yarns. As the average surface temperature of the filaments at the point of contact with aqueous liquid is increased within the 40° to 130° C. range, self-crimpability increases sharply. However, when this temperature exceeds 130° C., difficulties often are encountered with filaments sticking to each other and with subsequent threadline breakage during drawing. To obtain optimum operability and products of desirably high self-crimpability, average surface temperatures in the range of 75° to 115° C. are preferred when aqueous liquid is applied to the filaments.

While the air-quenched filaments are at a surface temperature in the desired range, an effective amount of water is applied to the filaments. Usually, the effective amount of water is equal to at least 1% of the weight of the filaments. The application of less than an effective amount of water results in a significant loss of latent crimp. This loss is believed to be caused by residual heat in the filaments at this point in the process, which heat relieves previously induced asymmetries. The effective amount can be applied as substantially pure water or as an aqueous liquid which also contains conventional textile finishes, such as those used as draw finishes. Aqueous liquids containing as little as 10% by weight of water can be satisfactory. There is no known upper limit on the amount of water that can be applied, other than that which will remain on the moving threadline at this point in the process. However, for practical operations, application of water amounting to between 5 and 12% of the weight of the filaments is preferred. It is believed that the effective amount of water cools and crystallizes the filaments sufficiently to set asymmetries introduced into the filaments up to that point in the process. It is also believed that the water itself can provide additional asymmetries. The temperature of the water or aqueous liquid being applied to the filaments is usually below the average surface temperature of the filaments immediately upstream of the point of water application. Preferably, the water or liquid temperature is in the range of 30° to 45° C., although a much wider range of temperatures is also useful. The method of water application is not critical. However, it is preferred to use a finish roll carrying an aqueous liquid film whose thickness is greater than the diameter of the filaments so that the filaments become substantially fully immersed and wetted as they pass over the finish roll.

In the drawing step of the process of the invention, the filaments are drawn mechanically at a draw ratio of at least 1.3:1 in such a way that the characteristics which impart self-crimpability to the yarn are not destroyed. Preferably, the draw ratio is in a range that maximizes the crimpability of the drawn yarn. It has been found that if the filaments are drawn at too high a draw ratio, the self-crimpability can be severely reduced. Also, drawing at a draw ratio below 1.3:1 usually results in fibers of undesirably high break elongation and inadequate tensile properties, especially at lower spinning speeds. In the drawing step, the filaments of the invention are drawn sufficiently to provide the filaments with a tenacity of at least 1.3 grams per denier, a break elongation of less than 120% and an ability to develop a substantially helical, frequently reversing crimp of at least 6 filament crimp index when exposed to a relaxed heat treatment. Preferably, the filaments are drawn to provide a tenacity in the range of 1.5 to 3.5 grams per denier, an elongation of at least 50% (most preferably 65 to 100%) and a capability of forming a substantially helical, frequently reversing crimp of at least 9 filament crimp index. Such filaments are preferred for premium carpets.

Figure 2:
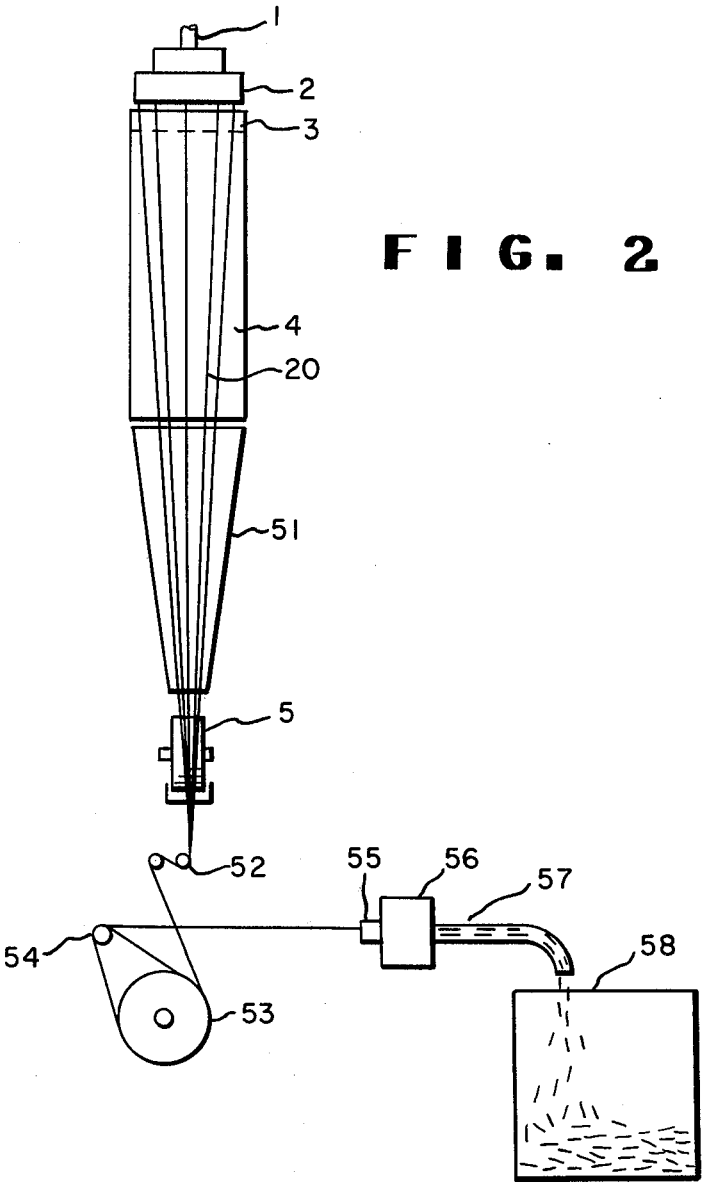
FIG. 2, which is described in detail in Example 2, is a schematic diagram of a continuous process for making staple fibers in accordance with the present invention.
Figure 3:
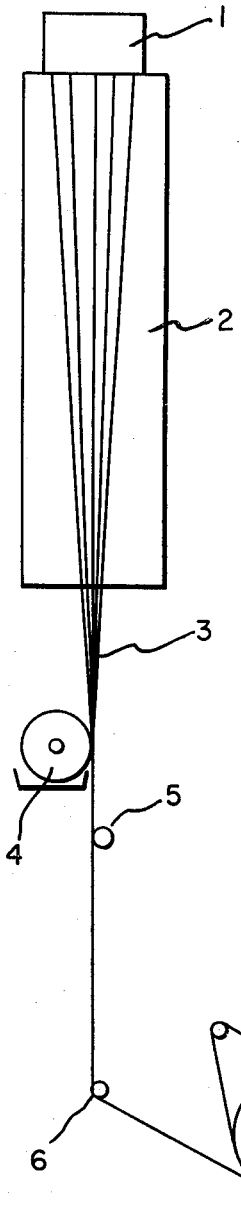
FIG. 3, which is described in detail in Example 4, depicts another embodiment of the invention, in which a self-crimpable continuous filament yarn is wound up directly after drawing.

It is preferred that the drawing step be carried out by forwarding the wetted filaments directly to a draw zone. Although an intermediate windup step can be employed prior to drawing, such "split" processing usually leads to less crimpability in the final product. In the drawing step depicted in FIG. 3, the filaments are drawn between rotating rolls. In FIG. 2, the drawing step is depicted as being carried out on snub pins. Drawing can also be carried out by combinations of rolls and pins, for example, as shown in FIG. 1. In each of these drawing methods, it is preferred that no additional heating be provided to the rolls, snub pins or filaments. Also, it is preferred that there be no release of threadline tension prior to drawing. Usually, the wetted filaments are fed directly to the draw zone at a velocity in the range of 450 to 2300 meters per minute, but preferably at velocities in the range of 800 to 1800 meters per minute. Mechanical draw ratios of at least 1.3:1 and up to about 2.6:1 are usually satisfactory. Surprisingly, under certain conditions of the invention, mechanical draw ratios in the range of 1.6:1 to 2.2:1 can maximize the self-crimpability characteristics of the fiber. This effect is shown in Example 5.

The manner in which the fibers of the invention are processed after drawing depends on whether the fibers are intended for continuous filament yarns or for staple fiber yarns. For continuous filament yarns, winding into a package may be accomplished immediately after drawing. However, it is usually preferred to treat the filaments in a hot-fluid jet, as in Example 1, before winding up the filaments. This treatment briefly raises the temperature of the filaments sufficiently to reduce the shrinkage of the filaments to a desired level (e.g., to less than about 7%). Preferably, the hot-fluid jet also is used to entangle the filaments to provide a more cohesive bundle, to prevent excessive follow-the-leader crimp and/or to partially develop the self-crimp in the filaments. Air is the preferred fluid for the jet. Jet air-temperature in the range of about 180° to 250° C., which provide yarn temperatures in the range of about 90° to 125° C., usually are adequate. Note that such yarn temperatures are achievable in the hot-air jets even at high processing speeds. This allows one to avoid the yarn preheating that is usually required for preparing crimped carpet yarns by jet-screen-bulking processes, such as that of Breen et al., U.S. Pat. No. 3,845,177. Jets suitable for the above purposes are disclosed by Coon, U.S. Pat. No. 3,525,134. The filaments emerging from the jet can be deposited in a relaxed condition on a foraminous surface and from there forwarded to a windup device. For preparation of staple fibers (e.g., as illustrated in FIG. 2), snub-drawn filaments of the invention can be forwarded to a device which cuts the filaments into staple fibers of the desired length. The staple fibers can then be processed by conventional techniques into yarns. Of course, staple fibers can also be prepared from the continuous filaments of the invention by simply removing the filaments from a wound-up package or from a final draw roll and then forwarding the filaments to a suitable cutting means. Note that in the staple fiber process reduction of shrinkage, if necessary, can be effected by use of a hot-air forwarding jet prior to cutting. However, such a reduction of shrinkage is preferably done after the staple-fiber yarns have been formed and before the yarns are used. For carpet yarns, reduction of the shrinkage and partial development of the crimp are desired in order to avoid excessive tuft pull-down of non-heat-set yarns during finishing of tufted carpets made from yarns of the invention.

It has been found that the process of the invention provides helically crimped fibers that are substantially free of mechanically induced deformations, such as those induced by twist-texturing, stuffer-box crimping, edge-crimping, etc. Also, the products of the invention have been found to have a fiber denier uniformity that is equivalent to that obtained with commercial carpet yarns prepared by the methods of Breen et al., U.S. Pat. No. 3,854,177, from hot-jet-screen bulked, more highly drawn, continuous filaments.

The present invention provides nonbulbous, monocomponent, drawn fibers of polyhexamethylene adipamide or of polycaproamide which are self-crimpable. Self-crimpability is the ability of these fibers, when subjected in a relaxed condition to a heat treatment for at least three minutes in boiling water at 100° C., to develop a substantially helical frequently reversing crimp of at least 6 filament crimp index, preferably of at least 9. Prior to crimp development, the fibers possess a crystal perfection index which is no greater than 70, and frequently, well below 50. Such low values of the crystal perfection infex is associated with the ability of the fibers to be dyed and heat-set more readily than similar more crystalline fibers.

Figure 6:
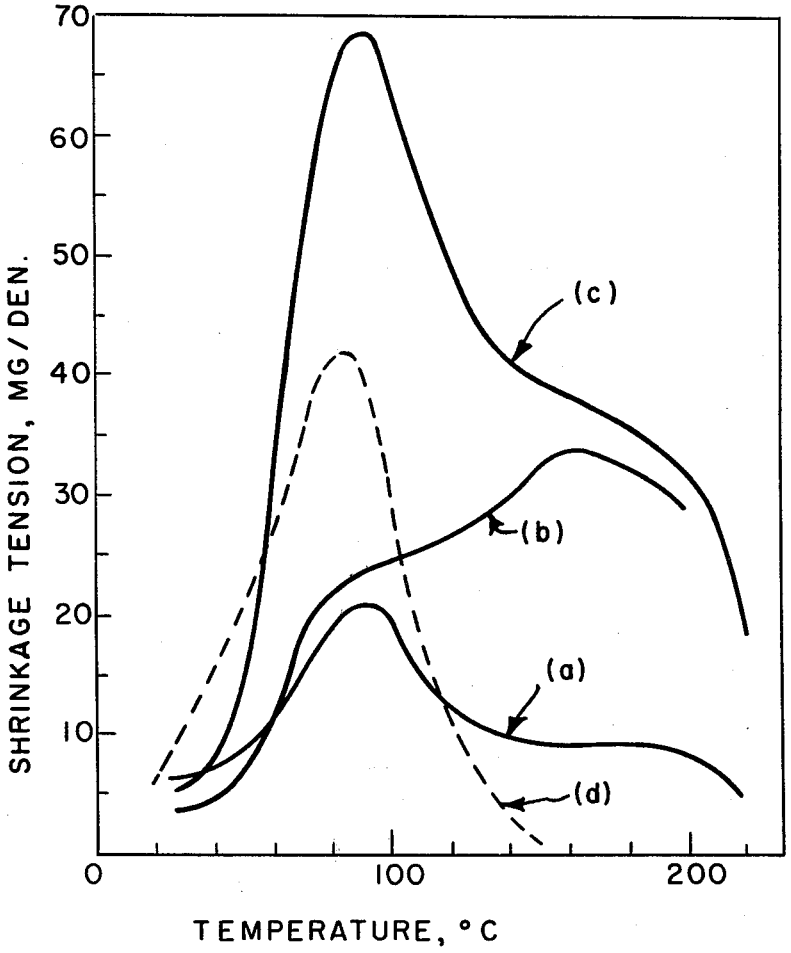
FIG. 6 is a plot of the shrinkage-tension-versus-temperature spectra for typical, drawn, self-crimpable fibers of the invention and for a non-drawn control.

Prior to crimp development, these drawn fibers also possess a characteristic shrinkage-tension-versus-temperature spectrum which exhibits two temperature regions of significant shrinkage tension as shown in FIG. 6. In particular, the spectra depicted in FIG. 6 were as follows. Curve (a) presents data for the low shrinkage-tension nylon 66 yarn of Example 1, whose manufacture included a 2.11:1 mechanical draw and a hot-air jet treatment. Curve (b) is for nylon 6 yarn B of Example 3 which was drawn 1.8:1 and hot-air jet treated. Curve (c) is for nylon 66 yarn 5.6 of Example 5 which was drawn 1.78:1 but was not hot-air jet treated. Each of these three spectra for yarns of the invention exhibit significant shrinkage tension for almost the entire temperature range of the test (i.e., from about 25 to 210° C.). In contrast to the spectra for yarns of the invention, the spectrum for a nylon 66 yarn that was melt-spun, cross-flow quenched, forwarded at 2740 meters/minute and then relaxed without drawing and without hot-air jet treatment, as shown by curve (d), exhibits no significant shrinkage tension at temperatures above about 160° C. Thus, drawn fibers of yarns of the invention are readily distinguished from undrawn yarns, even those undrawn yarns which are spun-oriented at high spinning speeds. It is believed that the first region of significant shrinkage tension, exhibited by both drawn and undrawn nylon fibers and yarns, which usually exists in the temperature range of 80 to 110° depends on the conditions of melt spinning and quenching under which the fibers were prepared. The second region of significant shrinkage tension, which is exhibited only by the drawn yarns and usually occurs in the 160° to 210° C. range, believed to depend on the amount of mechanical drawing imposed upon the fibers during preparation and on post-drawing heating and relaxation treatments. For the purpose of distinguishing the fibers of the invention from undrawn fibers, it is sufficient to note that drawn fibers exhibit a positive shrinkage tension (above preload tension) at a temperature of 180° C. (as measured from the shrinkage-tension-versus-temperature spectrum). Generally, the shrinkage tension at 180° C. for drawn fibers of the invention is at least 2 mg/den above preload tension, and preferably greater than 10 mg/den above preload. Shrinkage tensions at 180° C. of 30 mg/denier and higher are often obtained with fibers of the invention. As recorded herein, all shrinkage tensions are given in mg/den above preload tension, except in FIG. 6 where the preload tension is included.

Preferred self-crimpable fibers of the invention, surprisingly increase their break strength when subjected to the relaxed heat treatment. Tenacity increases of as much as 10% or more are sometimes attained.

The fibers of the present invention usually have an individual denier in the range of 5 to 40, preferably in the range of 5 to 25. The tenacity of the fibers is at least 1.3 grams per denier and preferably is in the range of 1.5 to 3.5 grams per denier. The fibers have a break elongation in the range of 50 to 120% and preferably in the range of 65 to 100%. Preferred fibers have a shrinkage of less than 7%. The preferred ranges provide the fibers with characteristics particularly suited for high quality carpet yarns.

The crimp that develops in the fibers of the invention, when the fibers are subjected to a relaxed heat treatment, is substantially helical and contains frequent reversals. Although all the crimp values reported herein are obtained when fibers of the invention are subjected to the specific heat treatment described above (i.e., in a relaxed condition for at least 3 minutes in water at 100° C.) the self-crimping can also be developed by heating the fibers in a relaxed condition to temperatures of 100° C. or more in other media, such as air. The crimped fibers of the invention have an average crimp frequency of at least 1.2 crimps per centimeter of extended fiber, and preferably a frequency of at least 2.4. Average crimp frequencies of as high as 4 or more can be present in some embodiments. The crimp frequency is quite variable, with the fibers often possessing a coefficient of variation of crimp frequency of at least 15%. The helically crimped fibers of the invention generally exhibit a reversal frequency of at least 0.6 reversal per centimeter of extended fiber; reversal frequencies as high as 2 are often present. It is believed that the variability of the crimp frequency and the frequent helix reversals in the crimped fibers of the invention assist in avoiding follow-the-leader crimp, which as indicated earlier, is undesirable in carpet yarns.

Figure 5:
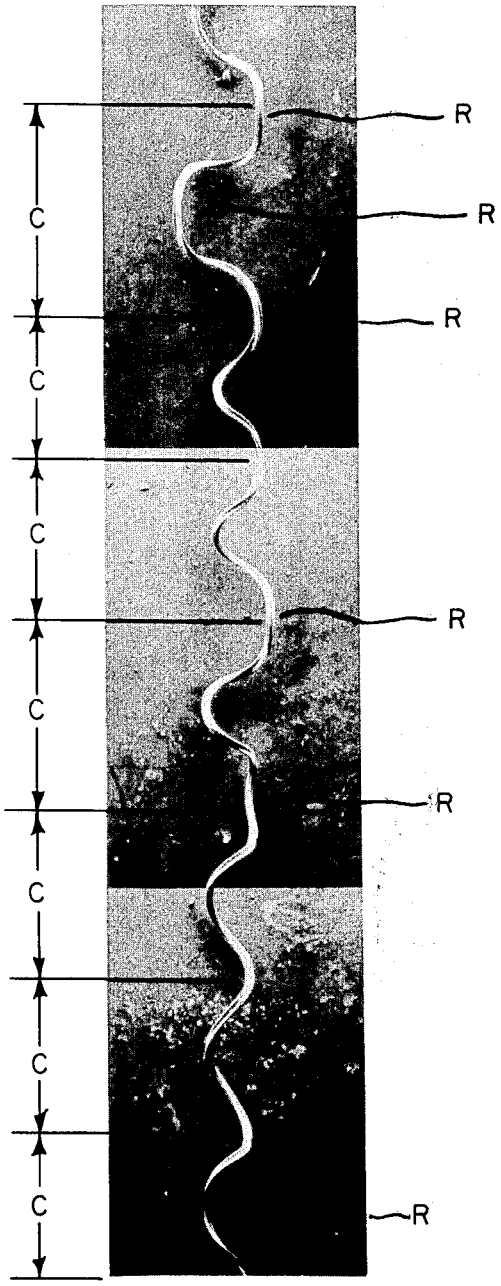
FIG. 5 is a photograph of a scanning electron microscope view of a crimped fiber of the invention.

FIG. 5 is a photograph of a scanning-electron-microscope view, of about a 1-cm length of a boiled-off, relaxed fiber of the invention. The substantially helical crimp form with frequent helix reversals is readily visible. On the figure, crimps are designated by "C" and reversals by "R".

The fibers of the present invention can be treated by additional mechanical techniques to impose additional types of crimp upon the basically helical crimp possessed by the fibers. For example, self-crimpable fibers of the invention can be further treated by a jet-screen-bulking process such as that disclosed by Breen et al., U.S. Pat. No. 3,854,177. A mild treatment of this sort can add a degree of kinkiness to the spiral crimp of the fibers. However, if in the jet-screen-bulking step the present fibers are heated to too high a temperature, the fibers do not self-crimp into a substantially helical form, but rather assume the non-helical form described by Breen et al. It is preferred that the kink frequency in heat-relaxed fibers of the present invention which are treated by a Breen et al. jet-screen-bulking step be limited to fewer than 1.6 kinks per centimeter of extended fiber. Absent any additional mechanical treatment, the fibers of the invention usually possess fewer than 0.4 kinks per extended centimeter. A low kink frequency is preferred in the substantially helically crimped fibers of the invention, for yarns intended for high luster carpets.

When the self-crimpable fibers of the invention are formed into yarns, the yarns possess the ability of self-crimp upon relaxed heat treatment to form bulky yarns, which possess a bundle crimp elongation of at least 20%, and preferably, in the range of 40 to 80%. However, for special purposes the yarns can possess bundle crimp elongation well above 80%.

In the preceding discussion and in the examples below, the following methods, unless otherwise specified, were used to determine the quantitative values reported herein. For several of the test procedures fiber or yarn is conditioned prior to testing. Unless otherwise specified, when conditioning is called for, it means that the sample is exposed for at least two hours in air at 21±1° C. and 65% relative humidity prior to testing.

Relative viscosity (RV) is the ratio of the absolute viscosity of a solution of 8.4 weight percent nylon 66 or nylon 6 (dry weight basis) dissolved in formic acid solution (90% formic acid and 10% water) to the absolute viscosity of the formic acid solution, both absolute viscosities being measured at 25±0.1° C. Prior to weighing, the polymer samples are conditioned for two hours in air of 50% relative humidity.

Crystalline Perfection Index is a measure of crystallinity of a nylon 66 or nylon 6 sample as determined by wide angle X-ray diffraction, as referred to by P. F. Dismore and W. O. Statton, Journal of Polymer Science, Part C, No. 13, 133–148, (1966) and in "Handbook of X-Rays", E. F. Kaelble, Ed., Chapter 21, McGraw-Hill Book Co., New York (1967).

Denier is defined as the weight in grams of 9000 meters of yarn or fiber. In measuring yarn denier, yarn is removed from a yarn package and slowly wound on an 18-cm long piece of cardboard with negligible tension. The yarn is aged at room conditions for at least one week and then conditioned just prior to denier measurement. For the denier measurement, the sample is removed from the card, suspended on a vertical 90-cm long cutter, loaded with a specified weight for at least three minutes for yarns having a denier no greater than 1900 and for at least six minutes for yarns having a denier above 1900, and then cut to 90-cm length. The specified weights are: 62 grams for yarns of no greater than 1000 denier, 125 grams for yarns of 1001 to 2000 denier, and 280 grams for yarns of greater than 2000 denier. The cut sample is then weighed on an analytical balance. The weight of the 90-cm-long sample in grams (measured to four significant figures) multiplied by 1000 equals the denier of the sample. The average of three such measurements is the yarn denier. In measuring fiber denier, the fiber sample is conditioned in a relaxed state. A fiber is then carefully removed from the sample, loaded to 0.13 gram per nominal denier and the actual denier of the individual fiber is then measured by means of a Vibrascope vibrational denier instrument (made by Satec System, Inc. of Grove City, Pa.). The fiber denier reported herein is the average of such measurements made on each of ten fibers from a given sample.

The shrinkage-tension versus-temperature spectrum can be determined on any one of several commercial instruments in which the shrinkage tension developed by a sample held at constant length is recorded as a function of temperature while the sample is being heated at a programmed rate. Among such suitable instruments are a Thermofil (made by Textechno of Germany) and a Thermomechanical Analyzer (made by E. I. du Pont de Nemours and Company Inc. of Wilmington, Del.). All samples are conditioned before testing. Yarn samples, if on a wound-up package, are conditioned on the package. Samples of fiber are conditioned in a relaxed state. For the yarn data reported herein, a sample of at least 20-cm length is securely tied into a loop and placed onto the two sample hooks of the tester, which are spaced 10 cm apart. For fiber samples, ten fibers are removed from the sample, arranged in parallel, placed between clamps located 10 cm apart and then placed on the sample hooks of the tester. (For shorter fibers, the distance between the clamps must be shortened accordingly and the distance between the tester hooks also modified). One of the tester hooks is permanently fixed; the other is attached to a sensitive tension-measuring cell. The sample is preloaded to a tension of about 5 milligrams per denier. The sample is then surrounded by a heater (e.g., a small, hot-air oven) and the sample is heated at the 30° C. per minute rate. An X-Y recorder plots the shrinkage tension versus temperature as the sample temperature is increased from the initial temperature (i.e., room temperature) to 240° C. The entire test is repeated three times and the shrinkage tension at 180° C. is determined. The shrinkage tension at 180° C. recorded herein is the average of the three determinations minus the initial preload tension.

Boil-off is the procedure used for developing the crimp in fiber or yarn samples prior to measurement of the crimp characteristics or of the tensile properties after boil-off. For yarns, a sample length of about 1 meter is coiled in a relaxed condition into a 10-cm diameter perforated can, and then immersed for three minutes in water that is rapidly boiling at 100° C. The can and sample are then removed from the boiling water, dipped into and out of water at room temperature to cool the sample, centrifuged to remove excess water, dried in a hot-air oven at 100° to 110° C. for one hour, and then conditioned for at least one hour prior to making any measurements on the sample. For fibers, a loose clump of fibers, measuring about 3 cm in diameter, is placed into a flat coarse-mesh, cloth bag, measuring about 13 cm long and 8 cm wide. The top of the bag is closed with a drawstring and the bag is then immersed for three minutes in water that is rapidly boiling at 100° C. cooled, centrifuged, dried and conditioned, in the same manner as the yarn sample, prior to making any measurements on the fibers.

Tensile properties of tenacity, elongation at break and modulus, before or after boil-off, are measured on an Instron TM-1130 stress-strain analyzer having an automatic recorder. All samples are conditioned before testing. For continuous filament yarn samples, the Instron tester is equipped with 50-kilogram load cell, industrial air-operated type-C clamps (at 4.22 kg/cm$^2$ pressure) and a twist counter. The equipment is set for a 15.24-cm sample length between the clamps and an elongation rate of 100% per minute (i.e., 15.24 cm/min extension). The yarn sample is clamped in the top clamp and twister, twisted 1.18 turns per centimeter, removed from the twister, passed through the lower clamp, and then loaded to 127 grams if the yarn is of 1200 to 1800 nominal denier, or to 272 grams if the yarn is of greater than 1800 denier. The lower clamp is then closed, the chart zeroed, and the sample elongated to break. For fiber samples, the Instron tester is equipped with a 500-gram load cell and chrome-plated, single-fiber, air-operated clamps (4.22 kg/cm$^2$ pressure). The equipment is set for a 2.54-cm sample length between the clamps and an elongation rate of 100%/min (2.54 cm/min extension speed). The sample fiber is then clamped in the top clamp, passed through the lower clamp, and loaded to 0.65 gram. The lower clamp is then closed, the chart zeroed and the sample elongated to break.

For the calculation of the tensile properties, as determined from the Instron tests, the average of three tests are used for yarns and the average of ten tests are used for fibers. Tenacity, in grams per denier, is determined by dividing the load at break (in grams) by the original denier of the sample. Elongation at break, in percent, is determined at the point of first filament failure, or in the case of fibers, at the point when the single fiber sample breaks. Modulus, in grams per denier per percent elongation multiplied by 100, is determined by dividing the load in grams at 10% elongation by the denier and multiplying the result by 10. Tenacity change on boil-off, expressed as a percentage, is simply defined as 100 times the increase in tenacity after boil-off as compared to before boil-off divided by the tenacity before boil-off.

Shrinkage is the change in extended length of yarn or fiber which occurs when the yarn or fiber is treated in a relaxed condition in boiling water at 100° C. To determine continuous filament yarn shrinkage, a piece of conditioned yarn sample is tied to form a loop of between 65 and 75 cm length. The loop is hung on a hook on a meter board and a 125-gram weight is suspended from the other end of the loop. The length of the loop is measured to give the before boil-off length ($L_1$). The weight is then removed from the loop. The sample is loosely wrapped in an open-weave cloth (e.g., cheesecloth), placed in 100° C. boiling water for 20 minutes, removed from the water, centrifuged, removed from the cloth and allowed to hang-dry at room conditions prior to undergoing the usual conditioning before further measurement. The dried, conditioned loop is then rehung on the meter board, the 125-gram weight is replaced, and the length of the loop measured as before to give the after boil-off length ($L_2$). The yarn shrinkage, expressed as a percent, is then calculated as $100(L_1-L_2)/L_1$, and as reported herein is the average of three such measurements for a given yarn. To determine fiber shrinkage, five individual fibers are randomly selected and carefully removed from a fiber sample. For enhanced visibility, measurements of the fiber lengths are made on a board covered with black velvet to which a metric ruler with a dark background and white markings is attached. One end of a fiber is taped to the ruler. The fiber is then carefully extended, with the aid of tweezers, until any crimp in the fiber is just straightened. Then the other end of the fiber is taped to the ruler. The distance between the tapes, which is arranged to be about 10 cm, is then measured accurately, to provide the before boil-off length ($L_1$). The fiber, with the tape at its ends, is then carefully lifted from the ruler. The tape at each end of the fiber is folded around the end of the fiber and inserted into a small spring-like clip for easy handling. Five specimens, prepared in this manner, are immersed in vigorously boiling water in a shallow pan, with the clips at each end of an individual fiber positioned close enough together to permit unhindered shrinkage while avoiding entanglement with the other samples. Boil-off time is about three minutes. The fibers are removed from the water in a relaxed condition and placed on the black velvet board for drying and length measurement. The after boil-off length ($L_2$) between the tapes of each individual filament is measured with the fiber carefully extended until any crimp in the fiber is just straightened. Shrinkage, expressed as a percent, is then calculated as $100(L_1-L_2)/L_1$. Fiber shrinkage is reported as the average of the measurements for the five fibers of the sample.

Crimp frequency, the coefficient of variation of crimp frequency and filament crimp index are determined from measurements made on the same instrument, a 1500-mg capacity Roller-Smith analytical balance (made by Biolar Corp. of North Grafton, Mass.). Crimp frequency is defined as the number of crimps per extended length in centimeters of a boiled-off, conditioned fiber, with the crimp being counted while the fiber is under 2 mg/den tension and the extended length being measured while the fiber is under 50 mg/den tension. A crimp is one complete crimp cycle (e.g., sine wave or helix turn) characteristic of the specimen's crimp form. Filament crimp index is defined as the difference in length of a boiled-off, conditioned fiber, measured (a) with 2 mg/den tension versus (b) with 50 mg/den tension, and is expressed as a percent of the extended length at 50 mg/den tension. The analytical balance used for these measurements is equipped with (1) a 100 mg-clamp hanging from the balance beam and (2) a vertically movable clamp, called a "transport", that has an associated vertical transport scale, which permits measurement of the extension of the fiber to within 0.01 centimeter. Initially the transport is adjusted so that the transport clamp and the balance clamp just touch each other and while in this position the vertical transport scale is read ($R_o$). A boiled-off, conditioned fiber is then mounted in the balance clamp and transport clamp, with the clamps positioned approximately 2 cm apart. The transport clamp is then moved until the fiber is under 2 mg/den tension. With the fiber under this tension, the transport scale is read again ($R_1$) and the number of crimps (N) is counted with the aid of a 2X magnifying glass. The transport is then moved until the tension is 50 mg/den, at which point, the transport scale is read again ($R_2$). From these data, crimp frequency, in crimps per extended centimeter, is calculated as $N/(R_2-R_0)$ and filament crimp index is calculated as $100(R_2-R_1)/(R_2-R_0)$. The results as reported for the average of twenty fibers per sample. The coefficient of variation of crimp frequency, (called "% C.V. of crimp frequency" in the tabulated data reported herein) expressed as a percent, is calculated from the twenty crimp frequency measurements by the expression:

$$\left[\frac{\Sigma(X-\overline{X})^2}{(n-1)}\right]^{\frac{1}{2}}\left[\frac{100}{\overline{X}}\right], \text{ where}$$

X is an individual crimp frequency measurement, $\overline{X}$ is the average of the measurements and n is the number of measurements (i.e., 20 in this case).

The reversal frequency is defined as the number of times per unit length of fiber the helical crimp reverses itself along the longitudinal axis of the fiber. Measurements are made on relaxed, boiled-off, dried, and conditioned samples. Five fiber specimens cut to about 5-cm length, are randomly selected from the sample. A small piece of tape is attached to each end of the specimen. The specimen, while in a relaxed condition, is then taped to a small black-velvet-covered board suitable for easy manipulation under a microscope. The specimen is viewed at 15X to 65X magnification under a binocular microscope with the specimen side lighted by a variable intensity incandescent lamp. The lamp and microscope are adjusted to enhance observation of changes in helix sense from left to right or vice versa. Each such change in sense is counted as one reversal. The number of reversals is counted along the entire length between the taped ends of the specimen. The specimen is then lifted by the tapes, transferred to a scale, carefully extended until the crimp is just straightened and the extended length between the taped ends is measured to the nearest millimeter. Total number of helical crimp reversals divided by the extended fiber length in centimeters equals the reversal frequency. Reversal frequencies reported herein are the averages for the five fiber specimens per sample.

Kink frequency is the number of kinks per centimeter of extended fiber length. A kink is a point along the longitudinal axis of a fiber where a bend, as observed in a two-dimensional view, departs from the substantially smooth form characteristic of helical crimp. Kinks are counted on fibers after crimp has been developed by the boil-off procedure previously described and after the fibers have been conditioned. Ten individual fibers are carefully removed from a boiled-off and conditioned sample and are mounted in relaxed state on a glass microscope slide to which double-faced adhesive tape is attached at each end. Fiber overlap is avoided. A cover glass slide is placed atop the slide with the fibers and 25X magnification prints are made with a large microfilm printer (e.g., one made by ITEK Business Products of Rochester, N.Y.). The number of kinks along each fiber is counted and the actual or "extended" length of the fiber is measured with a planimeter and corrected for the magnification. Kink frequency is the number of kinks divided by the "extended" or actual fiber length. The number reported herein is the average for the ten fibers per sample.

Bundle crimp elongation is the amount a boiled-off, conditioned yarn sample extends under a 0.10-gram/denier tension, expressed as percent of the sample length without tension. A boiled-off, dried, and conditioned specimen of yarn is used. If the specimen appears to be entangled or not straight, the specimen is held at one end and gently shaken prior to proceeding with the measurement. A 50-cm length ($L_1$) of specimen in a relaxed condition (i.e., with no tension) is then mounted in a vertical position. The specimen is then extended by gently hanging a weight on the yarn to produce a tension of 0.10±0.02 gram/denier. The extended length ($L_2$) is read after the tension has been applied for at least three minutes. Bundle crimp elongation, in percent, is then calculated as $100(L_2-L_1)/L_1$. Results reported herein are averages of three tests per sample.

Split distance, a measure of yarn cohesion, is defined as the distance that a pin travels when inserted into a moving threadline, under conditions of controlled yarn tension and speed, until the pull on the pin reaches a preset force. The distance, in centimeters, is measured with an Automatic Pin Drop Counter (APDC), similar to the one described for use with textile denier yarns in FIG. 8 of Gray, U.S. Pat. No. 3,563,021. The APDC of Gray is modified to adapt the instrumemnt for use with heavy denier carpet yarns. The brake is adjusted to give a tension of 30±5 grams between the needle holder assembly and the drive roll; the weight on the pivot needle is set at 80±5 grams entanglement force required to tilt the needle holder assembly; and the speed of the drive roll is adjusted to give a yarn speed of 320 cm/min. The yarn travels 6±1 cm between the point where the needle is retracted from the yarn and the point where the needle is inserted to start the next measurement. The instrument automatically averages the split distance for ten consecutive insertions. At least three such automatic determinations per yarn are averaged to obtain the split distances recorded herein.

The shape factor of the fiber cros-section is defined as the ratio of the radius of the smallest circle that can circumscribe the cross-section to the radius of the largest concentric circle that can be inscribed within the cross-section. In measuring the shape factor of some eccentric cross-sections, the center of the circumscribed circle may lie outside the filament cross-section and no circle with the same center can be drawn inside the cross-section; in such cases, the shape factor is considered to be infinity. Also, when calculating shape factor for hollow fibers, the cross-section is treated as if solid. The shape factors reported herein are averages for determinations made on enlarged photomicrographs of five cross-sections per sample.

Filament temperatures reported herein are measured with a scanning infrared (IR) pyrometer which compares the temperature of the moving threadline with a reference of known temperature. An instrument of this type, (e.g., and AGA Thermovision made by AGA Infrared Systems AB, Lidingo, Sweden) was used for measuring the temperatures of the filaments approaching the aqueous-liquid applicator in all examples, except Examples 4 and 6. For Example 4, a heat-flow nullpoint instrument (Fibertemp by Trans-Met Engineering, Inc., La Habra, Cal.) was used to measure temperature in accordance with the manufacturer's recommended procedures. The temperatures of the filaments were not measured in Example 6, but were extrapolated from other data.

Draw ratio as reported herein, is the velocity of the yarn at the draw roll divided by the velocity of the yarn entering the mechanical draw zone, which zone starts at a feed roll, snub pin or other such device, which is located downstream of the liquid applicator. When rolls with sufficient contact with the yarn to prevent yarn slippage are used, the surface-velocity ratio of the draw roll to the feed roll defines the draw ratio. When slippage is involved or when snub pins (without feed rolls) are used to induce drawing, it is necessary to measure yarn velocities directly. Yarn contacting wheels are used for heavier denier, cool yarn. In situations where such yarn-contacting devices can introduce measuring errors, such as when the yarn is hot or of light denier, a noncontacting device is used instead. A laser-Doppler velocimeter, which includes a helium-neon laser, photomultiplier and spectrum analyzer, is the noncontacting device employed herein for such velocity measurements. Such devices are described by G. C. Dubbledam, "The Accuracy of Flow Measurements by Laser Doppler Methods", Proceedings of the LDA Symposium, Copenhagen (1957), 588–592.

EXAMPLE 1

A preferred embodiment of the invention is described in this example. The process depicted in FIG. 1 was used to prepare self-crimpable continuous filament yarns, which were subsequently processed into carpets.

Polyhexamethylene adipamide polymer flake having a relative viscosity of 46 was conditioned, melted and metered by gear pump 1 through rectangular pack assembly 2, which contained sintered metal filters, screens, a distribution plate and a spinneret (Note: numerals refer to correspondingly designated parts in FIG. 1). The spinneret, which was rectangular, contained two groups of 80 spin orifices each. The orifices were arranged in seven rows, which were spaced 7.925 mm apart and within which the orifices were on a 7.366 mm center-to-center spacing. Each orifice consisted of three intersecting rectangular slots spaced 120° apart, each measuring 0.483 mm long by 0.178 mm wide by 0.305 mm deep and being interconnected in the width dimension to form a Y-shape. With the polymer melt at a temperature of 292° C. and pack pressure at 170 atm. gauge, the polymer was melt spun at a rate of 3.3 grams per minute per orifice into trilobal filaments which after drawing have a shape factor of 2.0. The extruded jet velocity was 13.3 meters/minute. The filaments had a relative viscosity of 65.

The melt-extruded filaments 20, which were handled as two groups of 80 each, were passed downwardly and converged to a feed roll 7 located 188 centimeters below the spinneret. (Note that in FIG. 1, only one of these groups of filaments is shown.) In advancing from the spinneret to the feed roll 7, the filaments passed sequentially through a 4½-centimeter long zone 3 of quiescent air, through a 147-cm long zone 4 of cross-flowing air, into contact with an aqueous liquid applicator 5 in the form of a finish roll located 165 cm from the spinneret, and then into contact with a grooved ceramic convergence guide 6 located 175 cm from the spinneret. Approximately 9.9 cubic meters per minute of air at 6° C. and about 80% relative humidity was supplied to air quench zone 4 such that the velocity of the cross-flowing air was about 0.54 meters per second in the first 89 cm length of the zone, about 0.46 m/s in the next 25 cm, about 0.29 m/s in the next 22 cm and about 0.10 m/s in the final 11 cm. In passing through the air-quench zone, the trilobal filaments were aligned such that the cross-flow was directed generally toward the tip of one of the lobes of the cross-section of each filament, rather than toward the area between lobes. The average air velocity in zone 4 was 0.46 m/s.

After passage from the cross-flow air-quench zone 4, the filaments, at an average surface temperature of about 95° C. were brought into contact with aqueous liquid carried as a film on rotating roll 5. The aqueous liquid, which was supplied at about 40° C., contained by weight 99% water and 1% non-aqueous draw finish materials. The surfaces of the filaments were substantially completely wetted by the liquid and the water pickup amounted to approximately 10% by weight of the filaments.

The filaments were then forwarded over convergence guide 6 to a feed roll 7 at which point the surface temperature of the filaments was about 70° C. The filaments were then forwarded to the draw zone, which included feed roll 7 around which the filaments were wrapped 3½ times, draw pins 31, and draw rolls 8, around which the filaments were wrapped about 9½ times. The surface speed of the feed roll was 886 meters per minute and the speed of the draw rolls was 1869 meters per minute, thereby drawing the filaments at a mechanical draw ratio of 2.11:1. Neither the feed roll nor the draw rolls was heated.

The filaments were then pulled from draw rolls 8, by hot-air jet 9 which advanced, shrank, deregistered, entangled and partially developed the crimp in the filaments. The jet, which was of the type described by J. M. Coon, U.S. Pat. No. 3,525,134, was supplied with air at a temperature of 215° C. and a pressure of 9.9 atm. gauge. The temperature of the filaments was 41° C. entering the jet and 95° C. leaving. Immediately after leaving the jet, the filaments were relaxed and cooled for about 0.1 to 0.2 second on perforated drum 10 through which air was sucked. The filaments were then pulled from the drum, treated with an oil/water emulsion from orifice applicator 11, passed around take-up roll 12, and then wound up on surface driven tube 13. In FIG. 1, the items designated 30 are idler rolls and 40 are stationary guides. The yarn had a split distance, as measured by the automatic-pin-drop-count procedure, of 1.3 cm, indicating a yarn of high cohesion. In contrast, similar yarns that had not been fluid-jet treated, such as the yarn of Sample 5.6 of Example 5 below, had a split distance of 19.3 cm, indicating a yarn of very low cohesion.

In the above-described continuous process, threadline tensions in grams per denier (at the specified location), were 0.025 before the feed roll 7, 0.21 in the draw zone, 0.09 upstream of jet 9, 0.03 immediately downstream of drum 10 and 0.21 at windup roll 13. Threadline velocities, as measured in meters per minute by a laser-Doppler velocimeter were 773 immediately upstram of water-applicator roll 5 and 880 immediately upstream of feed roll 7. The surface speeds of perforated drum 10, takeup roll 12 and windup roll 13 were respectively, 72, 1639 and 1652 meters per minute.

The properties of the resultant filaments are summarized in Table I along with the properties after boil-off, i.e., after the filaments were heated in a relaxed condition for at least three minutes in boiling (100° C.) water. Several additional runs, operated at substantially the same conditions, provided filaments having substantially the same properties as given in Table I, except that the filaments of the repeat runs had consistently higher shrinkages of about 5% and consistently higher shrinkage tensions at 180° C. of about 25 mg/den. As noted earlier, the filaments having the higher shrinkage tensions are preferred.

Eighty filament, 1400 denier yarns prepared as described above were twisted 1.22 turns/cm Z and two-plied 1.22 turns/cm S, continuously heat set in 138° C. saturated steam, backwound and then tufted into a primary carpet backing of woven polypropylene ribbons on a 0.476-cm. gauge cut-and-loop tufting machine to provide a 0.829 kg/m$^2$ carpet having a 1.91-cm pile height. The carpet was then Kuester-dyed and sheared. The yarns performed satisfactorily throughout the carpet making operations and the carpets made therefrom had softness, bulk, luster and durability in floor tests, which were judged equivalent to results obtained with hot-jet-screen bulked, continuous-filament, commercial carpet yarns.

EXAMPLE 2

The manufacture of self-crimpable staple fiber, which was subsequently processed into spun yarns and carpets, is described in this example with reference to FIG. 2. The melt-extrusion, quenching, and water-application equipment 1, 2, 3, 4 and 5 used in this example was similar to that used in Example 1. However, after water application, the filaments were drawn on unheated snubbing pins 52, by puller roll assembly 53 and 54. The filaments were then advanced by air jet 55 into a flying knife cutter 56, where the filaments were cut into staple fibers of 19 cm length and then air-conveyed to a collection box 58. Sufficient crimp was developed during the air conveying and collection steps to permit satisfactory carding and conversion into yarns by conventional means, not shown in FIG. 2. The details of this process follow.

Polyhexamethylene adipamide polymer, having a relative viscosity of 44±3 and 0.02% by weight $TiO_2$ was charged to an on-line conditioner, swept with a counter-current flow of heated humidified air adjusted to give a screw-melted and spun filament relative viscosity of 67±3. Melted polymer at 286 ±3° C. was metered through gear pump 1 into pack assembly 2 and then through a rectangular spinneret having 166 trilobal orifices at a rate of 4.79 g/min/orifice (total throughput 795 g/min). The orifices were arranged in seven rows, spaced 7.925 mm apart, within which orifices were on a 7.62-mm center-to-center spacing. Each orifice had three intersecting rectangular slots spaced 120° apart, each measuring 0.622-mm long by 0.155-mm wide by 0.508-mm deep and being interconnected in the width dimension to form a Y-shape, and terminated at each tip of the Y by a circular hole 0.203 mm in diameter. The slot length includes the circular tip. The thusly formed trilobal filaments, after drawing, had a shape factor of 2.47. The extruded jet velocity was 16.1 meters/minute.

The extruded filaments 20 were passed downwardly and converged at the snub pins 52 located 414 cm below the spinneret. In advancing from the spinneret to the snub pins, the filaments passed sequentially through a 2-cm-long zone 3 of quiescent air, through a 147-cm-long zone 4 of cross-flowing air, through a 156-cm-long tube 51, into contact with an aqueous liquid applicator 5 in the form of a finish roll located 376 cm from the spinneret. Approximately 9.9 cubic meters per minute of humidified air at about 6° C. was supplied to air quench zone 4 to give an air velocity distribution proportionally equal to that given in Example 1. In passing through the air-quench zone, the trilobal filaments were aligned such that the cross-flow was directed generally toward the tip of one of the lobes of the cross-section of each filament, rather than toward the area between lobes. Average air velocity in zone 4 was 0.46 meter/sec.

After passing from cross-flow air-quench zone 4 and through tube 51, the filaments, at an average surface temperature of about 80° C. (based on measurements made in separate temperature-versus-throughput tests) were treated with aqueous liquid applied by rolls 5 with surface velocity of 2107 cm/min. The aqueous liquid, which was supplied at about 35° C., contained by weight 88% water and 12% non-aqueous draw-finish material. The surfaces of the filaments were substantially completely wetted by the liquid and the water pickup amounted to approximately 7.5% by weight of filaments (based on measurement of 1.02% non-aqueous finish material on yarn).

The filaments were then converged to a pair of 2.54-cm diameter unheated snub pins 52 arranged such that the centers of the pins lay on a line perpendicular to the initial line of the bundle of filaments and 6.35 cm apart. From the snub pins, the filaments were pulled to pulling roll 53 and separator roll 54, around which rolls the filaments were wound 3½ times while increasing their velocity to 2286 meters/minute. Sufficient drawing was accomplished to give a break elongation of 103%. Yarn speeds, measured in separate tests, showed this process to give a draw ratio of about 1.7:1.

The filaments were then led into a cutter comprising two air-driven jets 55 between which passed two blades on a rotor 56. Air pressure of 11.2 kg/cm$^2$ gauge gave stable operation and 75 g tension to the filaments. The rotor was revolved at 6061 rpm. The filaments were thereby cut to staple fibers having an average length of 19 cm. The staple fibers were then air conveyed into a condenser 57 which stripped off excess air, controlled noise, and allowed the fibers to fall into box 58.

Propterites of the resultant staple fibers are summarized in Table I, along with the properties after boil-off.

Carpet yarns were prepared from the staple fiber by the steps of carding, pin-drafting, spinning and cable twisting. The yarns were then heat-set and tufted into a nonwoven primary carpet backing of spunbonded continuous filaments of polypropylene to provide 1.36-kg/m$^2$ saxony carpets having 2.2-cm pile height. Samples of the carpets, which were either batch dyed by beck or continuous dyed by Kuesters and then sheared, had an attractive, deep shade and satisfactory bulk. The yarn performed satisfactorily throughout all the carpet making operations and the resultant carpets performed well in floor tests, as compared to a commercial, stuffer-box crimped, staple fiber carpet yarn.

EXAMPLE 3

Two self-crimpable continuous filament yarns of polycaproamide polymer were prepared with equipment substantially as shown in FIG. 1 and described in Example 1, except that draw pins 31 and overlay finish applicator 11 were omitted. One yarn (Yarn A) was wound up immediately after drawing. The other yarn (Yarn B) was treated in a hot air jet before windup.

The polycaproamide polymer flake having a relative viscosity of 68 and a monomer content of about 5½%, was melt extruded at a temperature of 277° C. through two groups of 80 spinneret orifices at a rate of 3.2 grams/min/orifice to form trilobal filaments having a shape factor of 2.25. The extruded jet velocity was 12.8 meters/minute. The filaments, having a relative viscosity of 66, were then quenched by a cross-flow of 11.3 cubic meters/min of air at 6° C. with velocity profile as in Example 1 giving an average velocity of 0.53 meters/sec. The cross-flow of air, which was directed toward a lobe tip of the trilobal filaments, cooled the filaments to an average surface temperature in the range of 90°–95° C. The filaments were then substantially completely wetted, by means of a finish roll 5, with an aqueous liquid composed of 85% water and 15% non-aqueous finish materials and supplied at about 30° to 35° C. The wetted filaments were then drawn over unheated feed roll 7 and drawn rolls 8. For Yarn A, the filaments were pulled directly from the draw rolls 8 to takeup roll 12 at 0.09 gram/denier tension and then wound up on roll 13 at a tension of 0.3 grams/denier. For Yarn B, the filaments were pulled from the draw roll 8, by a hot-air jet 9, supplied with air at 200° C. and 8.2 atm. gauge, relaxed and cooled on drum 10, pulled by takeup roll 12 and wound on roll 13 at 0.3 grams/-denier tension. Table II summarizes the conditions under which these yarns were made and records some of their properties.

EXAMPLE 4

This example shows the important influence on fiber self-crimpability of the temperature to which the filaments are air-quenched immediately prior to application of aqueous liquid. The equipment depicted in FIG. 3 was used to prepare the products of this example.

Polyhexamethylene adipamide polymer flake was conditioned in dry nitrogen at 93° C. for 16.5 hours before being melt extruded at 290° C. through ten circular orifices located in spinneret 1. (Numeral designations in this example refer to FIG. 3). The spinneret orifices measured 0.254 mm in diameter and 0.381 mm in length and were arranged in a staggered pattern so that in subsequent cross-flow air quenching, all filaments were exposed to substantially the same cooling conditions. The extrusion rate was 3.2 grams/min/orifice. The relative viscosity of the resultant filaments was at least 55.

The melt-extruded filaments were cooled in quencher 2, which was divided into two zones in which the filaments were cooled by a cross-flow of air supplied at 8° C. The velocities of the cross-flow air were 0.58 meters/sec in the first zone, which extended from about 2.5 to 84 cm from the spinneret, and 0.40 meters/sec in the second zone, which extended from the first zone to a point 122 cm from the spinneret.

After emerging from quencher 2, the filaments passed through quiescent air zone 3 and then into contact with aqueous liquid applicator 4 followed by convergence guide 5. At a distance of 3.2 meters from the spinneret, the filaments changed direction of travel by about 60° by passage over change-of-direction air-bearing roll 6 and then traveled another 1.5 meters to feed and separator rolls 7 operating at a speed of 1180 meters/min. The filaments were then forwarded in succession to draw rolls 8, rolls 9 and surface driven wind-up roll 10. The filaments were wrapped around the feed rolls and draw rolls six times. The machine draw ratio applied to the filaments by the feed-and-draw-rolls combination was 1.8:1. None of the rolls was heated. Wind-up tension was 0.2 gpd. Each of the drawn filaments had a denier of about 13.6.

In all of the runs of this example, the above-described conditions were maintained constant, while the temperature to which the filaments were air-quenched immediately prior to aqueous liquid application was controlled to a series of different values in the range of 44° to 150° C. by moving the aqueous liquid applicator and guide closer to or further away from the spinneret. The applicator was in the form of a rotating finish roll which carried a film of an aqueous draw finish composed of by weight of 85% water and 15% non-aqueous components. All filaments contacted the finish roll for an arc of about 19° and were substantially completely wetted by the finish.

Further details of the runs and of the resultant products are summarized in Table III. Note that the tensile and bundle crimp elongation properties reported in the table are for 80-filament yarns which were made by combining, substantially without any twisting, the filaments prepared in the above-described runs. Note also that samples 4.7 and 4.8, for which the average surface temperature of the filaments at contact with the finish roll was 140 and 150° C., respectively, are not of the process of the invention, and are included as comparison runs.

As can be seen from the measurements of filament crimp index and of bundle crimp elongation, the self-crimpability of the fibers and yarns generally increase with increasing filament surface temperature at water contact. However, for comparison samples 4.7 and 4.8, in which the surface temperature was 140° and 150° C., respectively, filament-to-filament sticking was encountered, even though highly self-crimpable products were obtained. In larger-scale operations involving many more filaments per spinneret, such sticking can lead to operating difficulties and impaired yarn properties. On the other end of the surface temperature range, as shown by sample 4.1, as the surface temperature was reduced to 44° C., the self-crimpability was decreasing toward undesirably low levels.

Other tests performed at higher and lower extrusion rates, with trilobal as well as circular filaments, with and without hot-air-jet treatment, also showed the strong dependency of self-crimpability on the temperature of the filaments immediately prior to water application as well as the generally inadequate self-crimpability when this temperature was below about 40° C.

EXAMPLE 5

This example shows the strong effect that draw ratio can exert in enhancing the self-crimpability of fibers and yarns of the invention. The equipment, substantially as shown in FIG. 1 and described in Example 1, was modified so that the filaments of this example were drawn between feed roll 7 and draw roll 8 without draw pins 31 and wound up via roll 12 and roll 13 without being given a hot-air-jet treatment. In addition, the machine draw ratio was varied by adjusting the feed roll speed to a series of different values while maintaining the draw roll speed and final filament denier substantially constant. In substantially all other respects, with the following exceptions, the conditions and equipment employed in this example were the same as in Example 1:

Extrusion rate per orifice: 3.2 g/min
Extrusion jet velocity: 12.8 m/min
Aqueous liquid composition:
Water: 77%
Non-aqueous components: 23%

Other details of the runs and the resultant products are summarized in Table IV. Note that run 5.1, in which the draw ratio was 1.18, did not provide a product of the invention; the yarn exhibited a negative shrinkage tension at 180° C. Note also that runs 5.2 and 5.10, in which the draw ratios were about 1.3 and about 2.9, respectively, provided only marginal products.

The results given in Table IV show that self-crimpability of the fibers and yarns, as indicated by the filament crimp index and bundle crimp elongation measurements, went through a maximum at a draw ratio of about 1.8:1. In these runs, as draw ratio was decreased to below about 1.3:1 or increased to above about 2.6:1, self-crimpability was rapidly decreasing. When draw ratio was decreased to below 1.3 by increasing the feed roll speed further, while maintaining draw roll speed constant, self-crimpability decreased further to a minimum at about 1.2:1. Continuing to decrease draw ratio by increasing feed roll speed caused a rapid reversal from low to high self-crimpability, however filaments prepared in this manner were generally excessively stretchy (e.g., greater than 120% break elongation) and weak and did not exhibit a significant shrinkage tension at 180° C.

When similar runs were made with fibers of circular cross-section, the level of self-crimpability was usually somewhat lower (other variables being constant). However, enhancement of the self-crimpability was similarly obtained in the draw-ratio range from 1.6:1 to 2.2:1. In other similar tests, in which the filaments were hot-air-jet treated prior to wind-up, the resultant yarns confirmed the above reported effects of draw ratio on self-crimpability.

EXAMPLE 6

This example describes the preparation of a high-bulk self-crimpable continuous-filament yarn of the invention and its subsequent use in making carpets. Polyhexamethylene adipamide polymer flake having a relative viscosity of 43 was conditioned, melted and metered by gear pump 1 through four, cylindrical pack assemblies 2, arranged side by side, each containing sand filters, screens, a distribution plate and a spinneret (Note: numerals refer to correspondingly designated parts in FIG. 1). Each spinneret, which was cylindrical in shape, contained six spin orifices. Each orifice consisted of three intersecting rectangular slots spaced 120° apart, each measuring 0.508-mm long by 0.203-mm wide by 0.508-mm deep and being interconnected in the width dimension to form a Y-shape. The polymer, at a temperature of 296° C., was melt spun at a rate of 7 grams per minute per orifice into trilobal filaments having a shape factor of 1.8. The extruded jet velocity was 23 meters/minute. The filaments had a relative viscosity of 62.

The melt-extruded filaments 20, which were handled as four groups of six each, were passed downwardly and collected at feed roll 7, located about 470 cm below the spinneret. In advancing from the spinneret to feed roll 7, each group of six filaments passed sequentially through 150-cm-long zone 4 of cross-flowing air, over finish roll 5 located about 160 cm from the spinneret and then converged between ceramic guides 6 located about 175 cm from the spinneret. The trilobal filaments were aligned such that the cross-flow was directed generally toward the tip of one of the lobes of the cross-section of each filament, rather than toward the area between lobes. The average air velocity in zone 4 was about 0.4 meter/sec. The temperature of the quench air was 18.5° C.

After passage from the cross-flow air-quench zone 4, the filaments, at an estimated average surface temperature of about 110°–120° C., were brought into contact with aqueous liquid carried as a film on rotating roll 5. The aqueous liquid contained by weight 94% water and 6% non-aqueous draw finish materials. The surfaces of filaments were substantially completely wetted by the liquid.

The four groups of six filaments were then forwarded and collected at feed roll 7. The collected filaments were then forwarded to the draw zone, which included feed roll 7, draw pin 31 and draw rolls 8. The speed of the feed roll was 2027 meters per minute and the speed of the draw roll was 3648 meters per minute, thereby drawing the filament at a mechanical draw ratio of 1.80:1. Draw roll temperature was 130° C.

The filaments were then pulled from draw roll 8 by puller roll 12, treated with aqueous finish solution from a roll applicator (not shown) and wound up without jet treatment as 400-denier, 24-filament yarn on surface driven tube 13. The yarn had a tenacity of 2.8 grams/denier, an elongation of 54%, and a modulus of 8.8. Heat treatment of the yarn while relaxed in boiling water caused the filaments to develop frequently reversing helical crimps that varied in crimp frequency both along and among filaments. Crimp frequency was 3.1 per centimeter and reversal frequency was 2.4 per centimeter.

Figure 4:
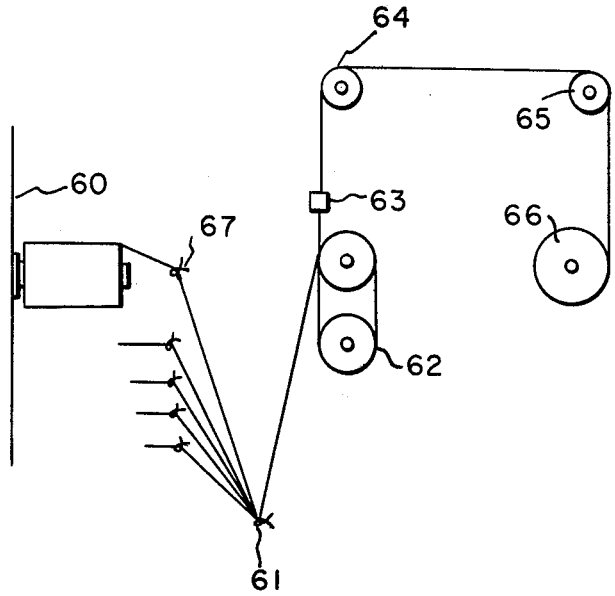
FIG. 4 which is described in detail in Example 6, is a schematic diagram of the equipment used for the hot-fluid-jet treatment of the yarns of that example.

The above-described yarn (before boil-off) was treated in a separate process step as depicted in FIG. 4 with a hot-fluid jet to shrink, entangle and partially develop the crimp. Five tubes of the 400-denier, 24-filament drawn yarn were fed from a creel 60, through pigtails 67, combined at eyelet guide 61 and then advanced to unheated feed rolls 62. The speed of the feed rolls was 224 meters per minute. The filaments were then pulled from the feed rolls by hot-fluid jet 63 which advanced, shrank, and entangled the filaments and partially developed the crimp in the filaments. Jet 63, which is described in FIG. 1 of Hallden and Murenbeeld, U.S. Pat. No. 3,005,251, was supplied with steam at a temperature of 240° C. and a pressure of 3.1 atm gauge. The filaments were then pulled by overfeed control roll 64 and tension control roll 65 and wound up on surface driven tube 66. The 120-filament yarn had a denier of 2339 and after relaxed treatment in boiling water developed a cohesive, helically crimped structure that had a bundle crimp elongation of 87%, a crimp frequency of 3.8 per centimeter and a kink frequency of 1.1 per centimeter.

The 2339-denier yarn was tufted on a 0.40-cm gauge, loop-pile tufting machine to provide a 0.678 kg/m$^2$ level loop carpet having a 1.27-cm pile height. The carpet was then dyed by a continuous dyeing process. The yarn performed satisfactorily throughout the carpet making operation and the carpet made therefrom had satisfactory cover, bulk and luster.

TABLE I

PRODUCTS OF EXAMPLES 1 & 2

| | Yarns of Ex. 1 | Fibers of Ex. 2 |
|---|---|---|
| Product Before Boil-Off | | |
| Denier | 1439 | 20.0 |
| Tenacity, gpd | 2.01 | 3.2 |
| Elongation, % | 74 | 104 |
| Modulus | 6.3 | 8.6 |
| Crystal perfection index | 63 | 56 |
| Shrinkage, % | 3.2** | 0.4 |
| Shrinkage-tension at 180° C., mgpd | 11 4*** | 33 |
| Product After Boil-Off | | |
| Denier | 1463 | 19.5 |
| Tenacity, gpd | 2.17 | 2.9 |
| Tenacity increase, % | 7.7 | −9 |
| Elongation, % | 67 | 99 |
| Modulus | 5.2 | 7.1 |
| Bundle crimp elongation, % | 57 | * |
| Crimp Characteristics of Fiber | | |
| Filament crimp index | 14.0 | 9.5 |
| Crimp frequency, cm $^{-1}$ | 3.6 | 2.6 |
| % C.V. of crimp frequency | 24 | 41 |
| Reversal frequency, cm$^{-1}$ | 2.6 | 1.9 |
| Kink frequency, cm$^{-1}$ | 0.7 | 0.3 |

*Not applicable for fibers.
**Repeat runs consistently showed this value to be about 5%.
***Repeat runs consistently showed this value to be about 25 mg/den.

TABLE II

PRODUCTS OF EXAMPLE 3

| | Yarn A | Yarn B |
|---|---|---|
| Process Conditions | | |
| Water pickup, % | 2.9 | 3.6 |
| Feed roll speed, m/min | 1186 | 1186 |
| Draw roll speed, m/min | 2116 | 2116 |
| Machine draw ratio | 1.78:1 | 1.78:1 |
| Jet treatment | No | Yes |
| Yarn Before Boil-Off | | |
| Denier | 1122 | 1140 |
| Tenacity, gpd | 2.71 | 2.29 |
| Elongation, % | 59 | 53 |
| Modulus | 7.2 | 6.0 |
| Crystal perfection index | 0 | 0 |
| Shrinkage, % | 17 | 14 |
| Shrinkage-tension at 180° C., mgpd | 44 | 29 |
| Yarn After Boil Off | | |
| Denier | 1187 | 1217 |
| Tenacity, gpd | 2.80 | 2.39 |
| Tenacity increase, % | 3.3 | 4.4 |
| Elongation, % | 86 | 72 |
| Modulus | 4.3 | 4.1 |
| Bundle crimp elongation, % | 26 | 22 |
| Crimp Characteristics of Fiber | | |
| Filament crimp index | 9.1 | 11.9 |
| Crimp frequency, cm$^{-1}$ | 2.7 | 3.4 |
| % C.V. of crimp frequency | 21 | 19 |
| Reversal frequency, cm$^{-1}$ | 1.3 | 1.6 |
| Kink frequency, cm$^{-1}$ | 0 | 0.6 |

TABLE III

PRODUCTS OF EXAMPLE 4

| Sample No. | 4.1 | 4.2 | 4.3 | 4.4 |
|---|---|---|---|---|
| Process Conditions | | | | |
| Distance of applicator from spinneret, cm | 310 | 235 | 207 | 152 |
| Filament temperature at liquid contact, °C. | 44 | 64 | 70 | 95 |
| Water pickup, % | 1.4 | 1.4 | 1.0 | 4.7 |
| Yarn Before Boil-Off | | | | |
| Denier | 1135 | 1129 | 1142 | 1143 |
| Tenacity, gpd | 2.28 | 2.28 | 2.57 | 2.40 |
| Elongation, % | 100 | 86 | 97 | 90 |
| Modulus | 6.9 | 7.8 | 8.0 | 7.0 |
| Crystal perfection index | 46 | 53 | 50 | 29 |
| Shrinkage, % | 3.9 | 4.5 | 4.8 | 5.4 |
| Shrinkage-tension at 180° C., mgpd | 13 | 23 | 35 | 15 |
| Yarn After Boil Off | | | | |
| Yarn denier | 1113 | 1126 | 1120 | 1129 |
| Tenacity, gpd | 2.48 | 2.86 | 2.56 | 2.80 |
| Tenacity increase, % | 8.8 | 25.4 | −0.39 | 16.7 |
| Elongation, % | 94 | 98 | 92 | 95 |
| Modulus | 6.6 | 6.8 | 6.3 | 6.2 |
| Bundle crimp elongation, % | 17 | 29 | 23 | 66 |
| Crimp Characteristics of Fibers | | | | |
| Filament crimp index | 6.2 | 6.9 | 6.9 | 11.4 |
| Crimp frequency, cm$^{-1}$ | 1.3 | 1.3 | 1.7 | 2.0 |
| % C.V. of crimp frequency | 32 | 49 | 22 | 28 |
| Reversal frequency, cm$^{-1}$ | 0.2 | 1.3 | 1.0 | 2.3 |
| Kink frequency, cm$^{-1}$ | ~0 | ~0 | ~0 | ~0 |
| Sample No. | 4.5 | 4.6 | 4.7 | 4.8 |
| Process Conditions | | | | |
| Distance of applicator from spinneret, cm | 130 | 102 | 89 | 79 |
| Filament temperature at liquid contact, °C. | 111 | 130 | 140 | 150 |
| Water pickup, % | 5.7 | 6.4 | 6.7 | 8.4 |
| Yarn Before Boil-Off | | | | |
| Denier | 1143 | 1152 | 1160 | 1105 |
| Tenacity, gpd | 3.03 | 3.17 | 2.77 | 2.35 |
| Elongation, % | 94 | 77 | 69 | 48 |
| Modulus | 7.9 | 9.2 | 9.1 | 9.3 |
| Crystal perfection index | 26 | 25 | 27 | 26 |
| Shrinkage, % | 5.8 | 10.8 | 10.9 | 13.6 |
| Shrinkage-tension at 180° C., mgpd | 34 | 31 | 79 | 85 |
| Yarn After Boil-Off | | | | |
| Denier | 1170 | 1228 | 1216 | 1143 |
| Tenacity, gpd | 3.07 | 3.25 | 2.92 | 2.86 |
| Tenacity increase, % | 1.3 | 2.5 | 5.4 | 21.7 |
| Elongation, % | 94 | 83 | 73 | 59 |
| Modulus | 6.6 | 6.4 | 5.8 | 6.1 |
| Bundle crimp elongation, % | 67 | 71 | 108 | 102 |
| Crimp Characteristics | | | | |
| Filament crimp index | 18.6 | 20.2 | 29.6 | 25.7 |
| Crimp frequency, cm$^{-1}$ | 2.4 | 2.7 | 3.3 | 3.9 |
| % C.V. of crimp frequency | 20 | 14 | 15 | 16 |
| Reversal frequency, cm$^{-1}$ | 2.8 | 3.3 | 3.8 | 4.6 |
| Kink frequency, cm$^{-1}$ | ~0 | ~0 | ~0 | ~0 |

TABLE IV

PRODUCT OF EXAMPLE 5

| Sample No. | 5.1 | 5.2 | 5.3 | 5.4 | 5.5 |
|---|---|---|---|---|---|
| Process Conditions | | | | | |
| Feed roll wpeed, m/min | 1767 | 1626 | 1514 | 1414 | 1245 |
| Machine draw ratio | 1.18 | 1.29 | 1.38 | 1.48 | 1.68 |
| Yarn Before Boil-Off | | | | | |
| Denier | 1125 | 1144 | 1144 | 1155 | 1157 |
| Tenacity, gpd | 1.71 | 1.85 | 1.93 | 1.98 | 2.20 |
| Elongation, % | 99 | 97 | 96 | 87 | 81 |
| Modulus | 4.6 | 5.2 | 5.5 | 5.9 | 6.5 |
| Crystal perfection index | 60 | 60 | 62 | 63 | 64 |
| Shrinkage, % | 1.3 | 2.9 | 3.6 | 4.3 | 5.6 |
| Shrinkage-tension at 180° C., mgpd | −2 | 2 | 6 | 11 | 23 |

TABLE IV-continued

| PRODUCT OF EXAMPLE 5 | | | | | |
|---|---|---|---|---|---|
| Yarn After Boil-Off | | | | | |
| Denier | 1097 | 1128 | 1154 | 1181 | 1214 |
| Tenacity, gpd | 1.95 | 2.09 | 2.12 | 2.11 | 2.22 |
| Tenacity increase, % | 14 | 13 | 9.8 | 6.6 | 0.9 |
| Elongation, % | 96 | 97 | 95 | 89 | 86 |
| Modulus | 5.1 | 4.9 | 5.0 | 5.2 | 4.9 |
| Bundle crimp elongation, % | 42 | 51 | 61 | 67 | 77 |
| Crimp Characteristics of Fibers | | | | | |
| Filament crimp index | 6.9 | 9.0 | 10.2 | 10.3 | 11.8 |
| Crimp frequency, $cm^{-1}$ | 2.4 | 2.4 | 2.5 | 2.4 | 2.6 |
| % C.V. of crimp frequency | 18 | 36 | 29 | 37 | 25 |
| Reversal frequency, $cm^{-1}$ | 2.0 | 1.5 | 1.7 | 1.9 | 2.4 |
| Kink frequency, $cm^{-1}$ | ~0 | ~0 | ~0 | ~0 | ~0 |
| Sample No. | 5.6 | 5.7 | 5.8 | 5.9 | 5.10 |
| Process Conditions | | | | | |
| Feed roll speed, m/min | 1178 | 1053 | 921 | 849 | 785 |
| Machine draw ratio | 1.78 | 2.02 | 2.43 | 2.63 | 2.85 |
| Yarn Before Boil-Off | | | | | |
| Denier | 1169 | 1159 | 1160 | 1178 | 1184 |
| Tenacity, gpd | 2.22 | 2.40 | 2.73 | 2.89 | 3.08 |
| Elongation, % | 76 | 71 | 60 | 56 | 50 |
| Modulus | 6.9 | 7.7 | 10.3 | 11.6 | 13.9 |
| Crystal perfection index | 65 | 68 | 64 | 64 | 63 |
| Shrinkage, % | 6.0 | 6.9 | 5.5 | 7.6 | 7.7 |
| Shrinkage-tension at 180° C., mgpd | 31 | 43 | 69 | 76 | 95 |
| Yarn After Boil-Off | | | | | |
| Denier | 1223 | 1205 | 1226 | 1240 | 1266 |
| Tenacity, gpd | 2.30 | 2.51 | 2.77 | 2.90 | 3.08 |
| Tenacity increase, % | 3.6 | 4.6 | 1.5 | 0.4 | 0 |
| Elongation, % | 82 | 75 | 71 | 65 | 62 |
| Modulus | 5.4 | 5.9 | 6.4 | 6.9 | 7.2 |
| Bundle crimp elongation, % | 81 | 70 | 67 | 57 | 48 |
| Crimp Characteristics of Fibers | | | | | |
| Filament crimp index | 12.7 | 10.5 | 10.4 | 9.6 | 5.6 |
| Crimp frequency, $cm^{-1}$ | 2.6 | 2.5 | 2.7 | 1.8 | 2.1 |
| % C.V. of crimp frequency | 29 | 36 | 26 | 33 | 29 |
| Reversal frequency, $cm^{-1}$ | 1.9 | 1.8 | 2.3 | 1.6 | 1.7 |
| Kink frequency, $cm^{-1}$ | ~0 | ~0 | ~0 | ~0 | ~0 |

We claim:

1. In a process for preparing self-crimpable monocomponent fibers, the process being of the type which comprises in sequence the steps of melt-spinning a polymer of polyhexamethylene adipamide or polycaproamide into filaments, air-quenching the filaments, contacting the filaments with water and then drawing the filaments, the improvement comprising:

quenching the filaments to an average surface temperature in the range of about 40° to 130° C. by a cross-flow of air having an average velocity of less than 3 meters per second, applying to the filaments, while at said surface temperature, an effective amount of an aqueous liquid, and drawing the filaments without any external heating at a draw ratio of at least b 1.3:1 to provide the filaments with a tenacity of at least 1.3 grams per denier, a break elongation of no greater than 120% and an ability, when subjected to a heat relaxation treatment, to develop a substantially helical, frequently reversing crimp of at least 6 filament crimp index.

2. A process in accordance with claim 1, wherein the cross-flow has an average velocity in the range of 0.1 to 1.5 meters per second and is applied in an air-quenching zone of at least 70-centimeter length, the quantity of water in the aqueous liquid applied to the filaments amounts to at least 1% by weight of the filaments, and the thusly wetted filaments are fed to a draw zone at a velocity in the range of 450 to 2300 meters per minute, and the filaments are drawn at a draw ratio of no more than 2.6:1.

3. A process in accordance with claim 2, wherein the polymer is polyhexamethylene adipamide which is melt spun into filaments having a relative viscosity of at least 50, at a rate of 1 to 7 grams per minute per spin orifice, the average surface temperature to which the filaments are air quenched is in the range of 75° to 115° C., the aqueous liquid substantially completely wets the surface of the filaments, the amount of water applied is in the range of 1 to 15%, the velocity of the filaments entering the draw zone is in the range of 800 to 1400 meters per minute and the draw ratio is at least 1.6:1 to produce filaments having a denier of 5 to 25 and the ability, when subjected to the relaxed heat treatment, to exhibit at least a 9 filament crimp index.

4. A process in accordance with claims 1, 2 or 3 wherein the wetted filaments are drawn with unheated rolls.

5. A process in accordance with claim 1, 2 or 3 wherein the wetted filaments are drawn on an unheated snubbing pin.

6. A process in accordance with claims 1, 2 or 3 wherein the filaments are hot-fluid jet treated to deregister and entangle the drawn filaments and reduce their boil-off shrinkage to less than about 7%.

7. A process in accordance with claims 1, 2 or 3 wherein the filaments, after drawing are cut into fibers of 10 to 20 centimeter length.

* * * * *